United States Patent [19]

Domian

[11] Patent Number: 4,606,131

[45] Date of Patent: Aug. 19, 1986

[54] INTERCHANGEABLE GUN SIGHT

[75] Inventor: Robert E. Domian, Somers, Conn.

[73] Assignee: Kingston Tool Co. Inc., Monson, Mass.

[21] Appl. No.: 523,336

[22] Filed: Aug. 22, 1983

[51] Int. Cl.[4] ..... F41G 1/26; F41G 1/18

[52] U.S. Cl. ..... 33/257; 42/100; 33/256

[58] Field of Search ..... 42/15; 33/233, 251, 33/252, 257, 258, 256, 260

[56] References Cited

U.S. PATENT DOCUMENTS

| | | | |
|---|---|---|---|
| 873,112 | 12/1907 | Windridge et al. | 33/251 |
| 2,148,272 | 2/1939 | Kyle | 33/258 |
| 2,187,096 | 1/1940 | Pomeroy | 33/257 |
| 2,438,601 | 3/1948 | Davis | 33/257 |
| 2,494,163 | 1/1950 | Davis | 33/257 |
| 2,963,789 | 12/1960 | Wilhelm | 33/257 |
| 3,495,339 | 2/1970 | Elliason | 42/15 |
| 3,662,469 | 5/1972 | Charron | 33/257 |
| 3,748,744 | 7/1973 | McClenahan | 33/257 |
| 3,942,256 | 3/1976 | Khaidurov et al. | 33/257 |
| 4,200,989 | 5/1980 | Brouthers | 33/257 |

*Primary Examiner*—Charles T. Jordan
*Assistant Examiner*—Ted L. Parr
*Attorney, Agent, or Firm*—Wolf, Greenfield & Sacks

[57] ABSTRACT

An adjustable rear sight for handguns is disclosed wherein the sight is specially designed for easy interchangeability of its sight blade or leaf by removal of a minimal number of parts. The sight blade is removably held in a dovetail channel of the sight's main body by basically only a screw-headed pin or stop that fits into a groove in the head of the windage screw for the sight.

If a user desires to repair a broken blade or replace it with a new one having a different-sized sight notch, he merely unscrews the stop pin and slides the blade (with the attached windage screw) out of the main body. The screw is then placed in a new leaf and slid back into the channel, where it and the new leaf are securely held in place by screwing the pin back into the body.

27 Claims, 12 Drawing Figures

INTERCHANGEABLE GUN SIGHT

BACKGROUND OF THE INVENTION

This patent relates to firearms and more particularly to an adjustable rear sight for handguns.

Handguns are used to fire at a variety of targets at different distances. Sometimes a weapon is used at a practice range to fire at a target 25 to 50 meters away. Other times, the same weapon is used to fire at a target farther away, such as during hunting or during use at "pop-up target" ranges, where the distance to the target can be up to 100 or 200 meters away.

Usually, the finer handguns have adjustable rear sights with sight blades that are adjustable vertically to compensate for lost elevation of a shot and horizontally to correct for any deflection caused by windage. The blades have notches for locating the shot and precisely aiming it to the target. Depending upon the distance to the target, the size of the notch should ideally be changed. For short distances, a wider notch should be used to quickly "fix" a 25 meter silhouette in the sight. For longer distances, a smaller notch is better for concentration. It eliminates the unnecessary peripheral objects and allows the shooter to concentrate squarely on his target.

Ideally it would be preferred if the sight blade for an adjustable sight could be readily changed. Unfortunately, some prior gun sights use a plurality of tiny parts that prevent ready change. If the blade were changed quickly, a part could be lost in the field and the sight could no longer be used. Other prior sights use a blade that is integrally attached to an elongated main body or tongue. The blade cannot be changed unless the entire main body is removed.

Accordingly, it is a primary object of the present invention to provide an adjustable rear sight for handguns wherein the sight includes an interchangeable sight blade or leaf that can be readily changed.

It is another general object to provide an adjustable rear sight with a sight blade that moves separately of the slight's main body and which can be quickly replaced by removing only a minimal number of parts.

It is another object to provide a sight blade which is removably, but securely, held in the sight's main body by a single set screw.

It is yet another object to provide an improved, adjustable sight that is inexpensive to manufacture, simple and rugged in construction, compact and very efficient and durable to use.

The above and other objects and advantages of this invention will become more readily apparent when the following description is read in conjunction with the accompanying drawings.

SUMMARY OF THE INVENTION

An adjustable rear sight for handguns is disclosed wherein the sight is specially designed for easy interchangeability of its sight blade. The sight blade is removably held in a dovetail channel of the sight's main body, for horizontal movement therein, by basically only a screw-headed stop pin or set screw that fits through the body and into a groove in the head of the windage screw for the sight.

If a user desires to repair a broken blade or replace it with a new one having a different-sized sight notch, he simply unscrews the stop pin and slides the blade out of the channel with the windage screw attached to the back of it. He then removes the screw from the old blade and threads it into a new leaf. Then, he slides the new leaf (with the attached windage screw) back into the channel and replaces the pin to hold the new leaf in place.

DETAILED DESCRIPTION OF THE PREFERRED EMBODIMENT

Figure 1:
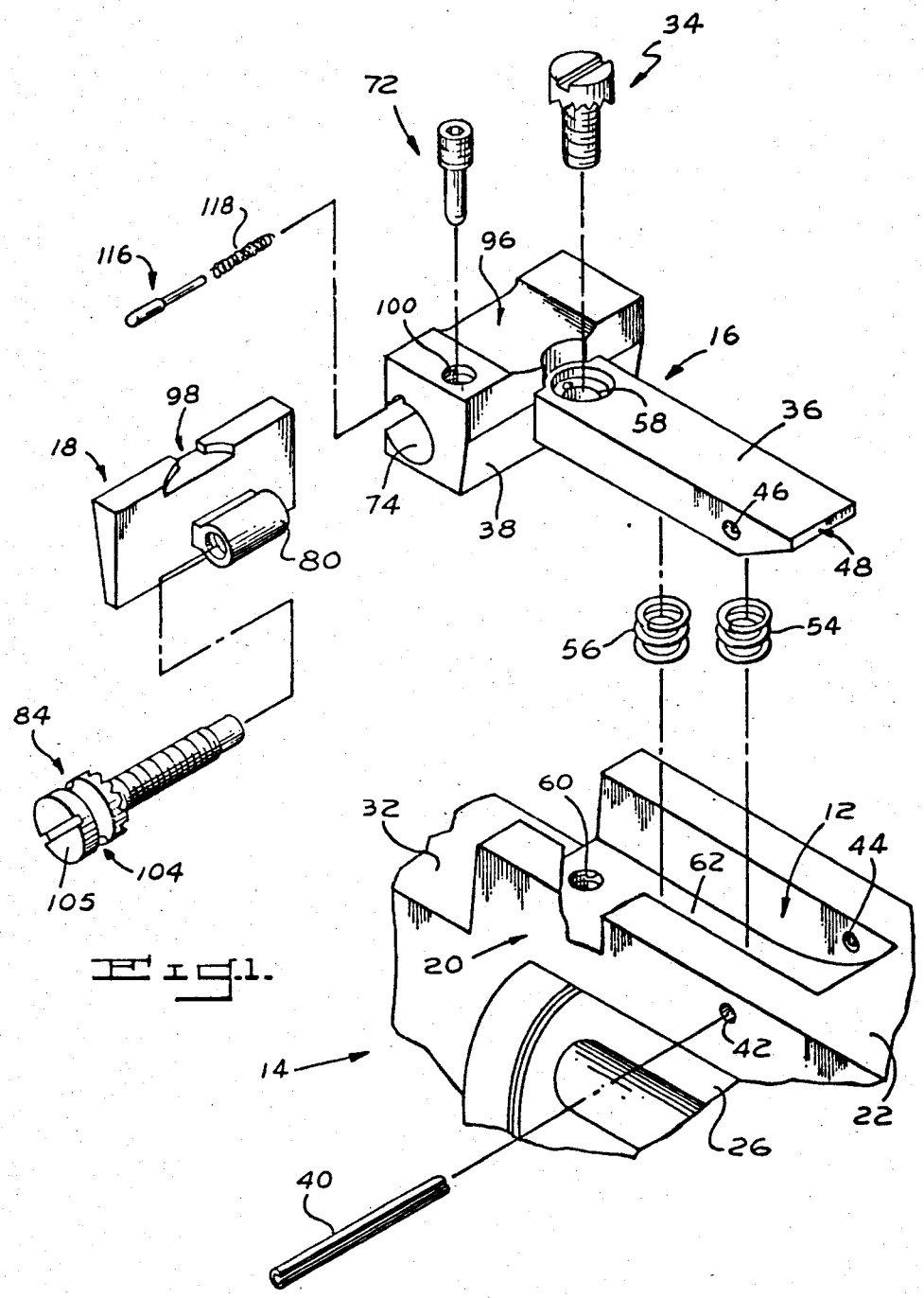
FIG. 1 is an exploded perspective view of a rear sight constructed in accordance with the present invention and a portion of the top of a representative handgun in which the sight can be housed.

Referring to the drawings in detail, an interchangeable gun sight is illustrated and generally designated by the reference numeral 10. The sight is designed to be housed in a longitudinal slot 12 in the top of a handgun (such as the representative weapon illustrated at 14). It includes a main body 16 with a thin sight leaf or blade 18 that can be easily removed for repair or replacement.

Figure 3:
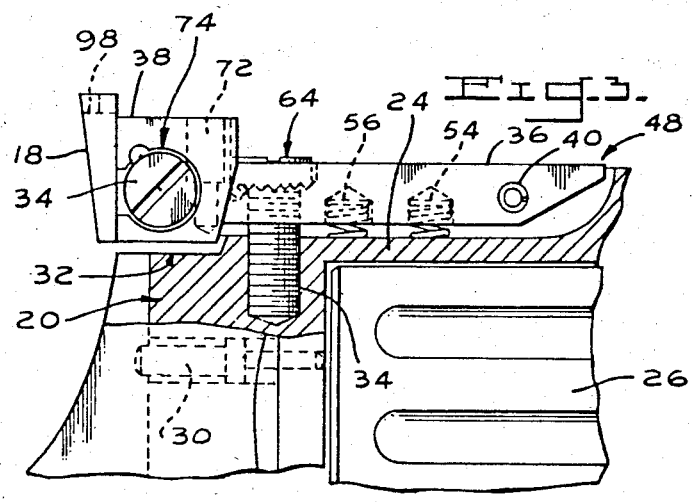
FIG. 3 is a fragmentary view of the assembled sight housed in the FIG. 1 gun.
Figure 4:
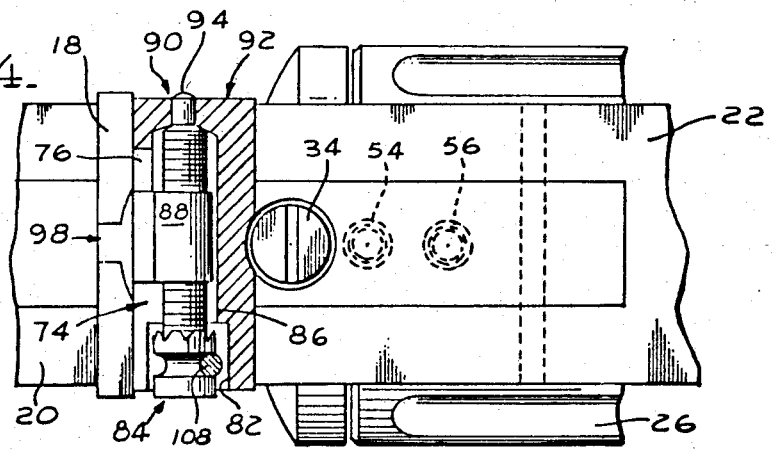
FIG. 4 is a top paln view of FIG. 3 with the sight's main body partially cut away in the area of the invention's sight blade and windage screw.

The drawings depict only rear fragmentary portions of the handgun 14 near slot 12 because the remainder of the gun is standard and further illustration would offer nothing more in the description or understanding of the present invention. In this connection, FIGS. 1, 3 and 4 show a handgun having a frame 20 with a top strap 22 in which the slot is located. The frame 20 incudes a thin-walled section 24 that overlies the opening for the weapon's cylinder 26 and a rear section disposed over the firing pin 30. Further, it includes an indented ledge 32 that is adjacent to both the slot 12 and the top of an uncocked or depressed hammer (not shown). As described more fully in U.S. Pat. No. 4,200,989 to Brouthers, the disclosure of which is incorporated herein by reference, this type of arrangement optimizes the range of the weapon's elevation screw 34 and thus the elevational adjustment of the weapon.

The main body 16 of sight 10 includes an elongated, forward portion or narrow tongue 36 for pivotally attaching the sight to the inside of the slot 12 and a wider sight block portion 38 at its rear for removably housing the sight leaf 18. The tongue 36 is pivotally attached to the top of frame 20 by a pivot pin or trunnion 40 that fits through side holes 42, 44 in the frame and an aligned pivot channel 46 near the front 48 of the tongue.

Figure 5:
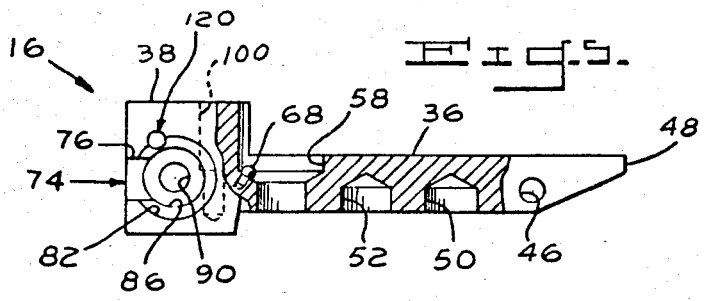
FIG. 5 is a side elevational view of a main body for the sight, with portions broken away to illustrate holes for housing an elevation screw and two elevation springs shown in FIG. 1.

Moving from right to left in FIG. 5, the tongue 36 includes a pair of upstanding wells 50, 52 in its underside for housing two coiled elevation springs 54, 56 shown in FIG. 1. Further, it includes a countersunk, smooth through bore 58 for receiving the elevation screw 34. When the sight is attached to the gun, the elevation screw 34 fits through the bore and into a tapped hole 60 in the base 62 of slot 12 and the springs bias against the base 62 to force the tongue to pivot to the extent that the elevation screw 34 will allow.

In the sight's assembled position, the head 64 of elevation screw 34 sits in the stepped or countersunk portion of through bore 58. The bottom edge of its head has a serrated-type edge forming detents 66 which interlock with the ball 68 of a ball-and-stake arrangement stakes in a hole in the bore.

To adjust the elevation of the sight 10, the screw is turned. If the sight needs to be lowered, the screw is turned clockwise so that it advance downwardly toward the slot's base 62 and its head 64 forces the tongue to pivot downwardly. On the other hand, if the sight needs to be raised, the screw is loosened so that its head 64 retreats away from the base and the springs cause the tongue 36 to pivot upwardly.

A close interrelation between the serrated edges 66 and the ball 68, caused by normal upward biasing of the springs 54, 56, produces a fine clicking adjustment with regards to elevation of the sight. Moreover, the screw 34 is provided with a straight, central channel in its head for accommodating a flat-head screwdriver or similar tool for vertical adjustment of the sight. However, if desired, the head could instead have a hexagonal opening for accommodating an Allen wrench, such as the opening shown in the screw-headed stop pin 72 shown in FIG. 1.

Moving again from right to left in FIG. 5, the sight block 38 is integral with tongue 36. It includes a dovetail channel 74 for slidably and removably housing a sight leaf such as that shown at 18. The dovetail channel is of substantially circular shape and has at one side an elongated groove 76 for slidably receiving the stem 78 of a key-shaped windage bar 80 attached to the back of sight blade 18.

As best shown in FIGS. 4 and 5, the semicircular portion of dovetail channel 74 comprises a three-step bore having a widened portion 82 at one end for receiving the head of a windage screw 84; a narrower central portion 86 for slidably housing a right-cylinder portion 88 of key-shaped windage bar 80; and, an end portion 90, that is actually a hole in the side 92 of block 38, for receiving a pin end 94 of the windage screw 84. The hole 90 acts as a bushing and rotatably supports the windage screw in the channel 74 when it is turned to adjust the horizontal position of sight leaf 18 in the sight block 38.

As best shown in FIG. 1, the top of sight block 38 includes an arcuate furrow 96 that registers with the sight notch 98 of blade 18 to provide a clear line of sight to the desired target (not shown). Due to its wide spanse, a portion of the furrow is able to register with the sight notch even if the blade has been shifted horizontally to compensate for windage.

Block 38's top also includes a vertically extending threaded bore 100 that opens into the widened portion 82 of dovetail channel 74. The bore 100 is adapted to receive the screw-headed stop pin 72 or set screw so that the pin cooperates with a groove 104 in the head 105 of the windage screw 84 to removably hold both the screw 84 and sight blade 18 in the dovetail channel 74.

Figure 6A:
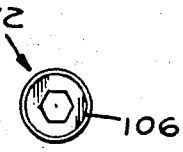
FIG. 6A is a top plan view of a screw-headed stop pin shown in FIG. 1.
Figure 6B:
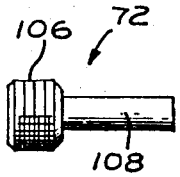
FIG. 6B is a side elevational view of the pin.

As best shown in FIGS. 1, 6A and 6B, the pin 72 has a screw-threaded head 106 with a hexagonal opening to accommodate an Allen wrench. When the head is screwed into bore 100, a smooth stem 108 fits into the groove 104 and acts as a stop for the windage screw (see FIG. 4). The stem 108 prevents the screw 84 from being removed from sight block 38 but permits it to be turned in the dovetail channel 74 to adjust the horizontal position of sight notch 98.

Figure 7A:
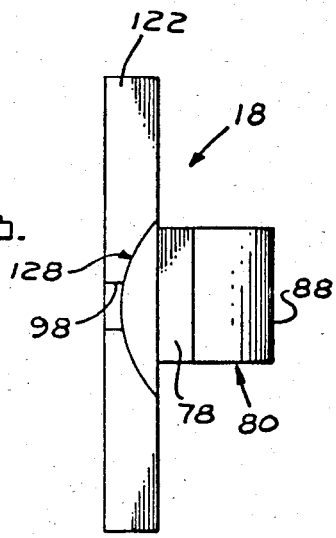
FIG. 7A is a top plan view of the sight blade.
Figure 7B:
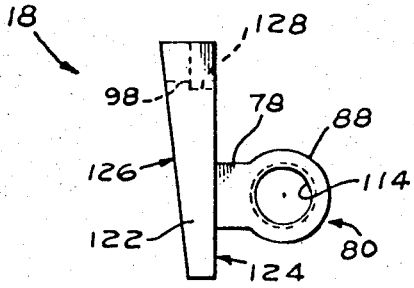
FIG. 7B is a side view of the blade.
Figure 7C:
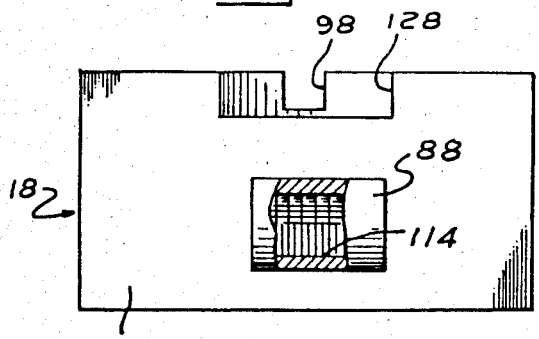
FIG. 7C is a rear elevational view of the blade, with portions of an integral windage cylinder removed to show a screw-threaded bore for housing the screw and advancing the block when the screw is turned.
Figure 8:
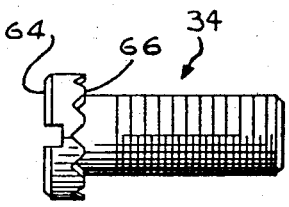
FIG. 8 is a side view of the elevation screw shown in FIG. 1.
Figure 9:
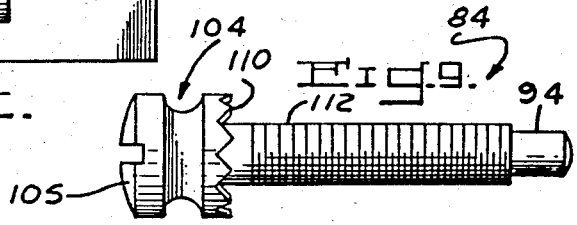
FIG. 9 is a side view of the sight's windage screw.

Moving from left to right in FIG. 9, the head 105 of windage screw 84 has a straight channel at one end for accommodating a flat-end screwdriver or similar tool to turn the screw. In addition, the screw has groove 104 along the head's midlength, a serrated-type edge forming detents 110 at the bottom of the head, and a stem with a threaded midportion 112 that terminates into the previously described narrow pin end 94. The screw's threaded midportion is adapted to fit snugly into and cooperate with a complementary threaded bore 114 in the right-cylinder portion of windage bar 80 (see FIG. 7) to screwably advance the sight notch 98 to its desired horizontal position as the screw is being turned.

Figure 2:
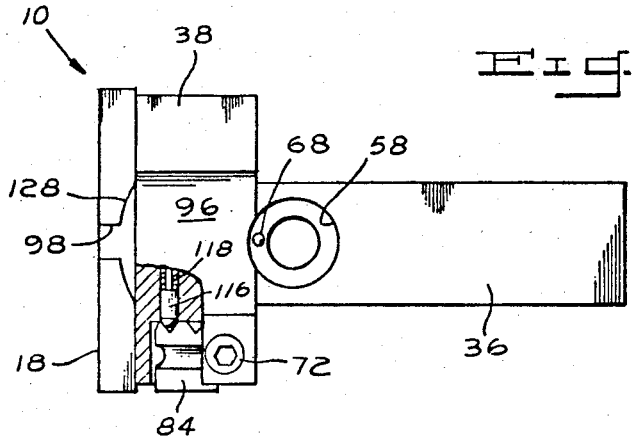
FIG. 2 is a top plan view of the rear sight, when assembled, with portions broken away to show the cooperation of its windage screw with its detent plunger.

During turning of the screw 84, its serrated edge 110 cooperates with a detent plunger 116 and coiled spring 118 housed in a 10 o'clock well 120 in the dovetail channel 74 (see FIGS. 2 and 5). The tip of the detent plunger 116 and the serrated edge 110 combine to produce a fine clicking action to tell the user exactly how much he needs to turn the screw to adjust the blade to a desired position.

Referring now to FIGS. 1 and 7A–C, sight blade 18 includes a thin, vertical plate 122 having a perpendicular back face 124 and a slightly canted front face 126. On top of the plate 122 is the sight notch 98 and an adjacent arcuate furrow at 128. Attached to its back free is the key-shaped windage bar 80 and the right-cylinder portion 88 with its threaded 114.

To assemble the sight 10, windage screw 84 is threaded into the windage bar's bore 114, and the attached screw and windage bar are slipped into the dovetail channel 74, with the flat stem 78 sliding along in the side groove 76 of the channel. The stop pin 72 is then screwed into bore 100 to securely hold the blade 18 in place.

The sight 10 is specially designed for quick interchangeability of its sight blade. A variety of blades can be made available for the invention with different-sized sight notches so that a particular sight notch can be selected to fit the particular occasion. For example, although blade 18 has been shown with a fairly narrow sight notch 98, a similarly shaped blade having a wider notch could also be used. This blade (not shown) would have the same overall shape and size as blade 18, with the only difference being the length of the notch in its top.

To use a different blade, a person merely removes the pin 72 from block 38 and slides the windage screw 84 (with the old sight blade attached to it) out of channel 74. After removing the screw from the blade's bore 114, he inserts the screw back into a similar bore of the new leaf. Then, he slips the windage screw 84 and new leaf back into the dovetail channel 74, where the two are securely held in place after the stop pin is screwed back into place.

It should be understood by those skilled in the art that obvious structural modifications can be made without departing from the spirit of scope of the invention. Accordingly, reference should be made primarily to the accompanying claims rather than the foregoing specification to determine the scope of the invention.

Having thus described the invention, what is claimed is:

1. An adjustable rear sight for a handgun comprising:

(a) a main sight body having an elongated tongue adapted to be pivotally housed inside a longitudinal slot in the top strap of the frame of the gun, said tongue having means adjacent one end for pivotally attaching it to the inside of the slot;

(b) said main body including a sight block that is integral with the opposite end of said tongue but wider than it, said block having a dovetail channel for slidably receiving both a key-shaped windage bar of a sight leaf and a windage screw that is screwably attached to the windage bar, wherein said dovetail channel extends from one side of said block toward the opposite side and comprises an elongated groove along an end of the block and a semicircular portion parallel with it;

(c) a sight leaf adapted to be slidably receiving within said dovetail channel, said leaf including an upstanding plate having the key-shaped windage bar attached to one face of it, said bar having a right cylinder portion with a threaded bore for threadedly receiving the windage screw and being advanced or retracted in the channel by the screw for horizontal adjustment of the sight when the screw is turned;

(d) a windage screw having a head adapted to be received in said semicircular portion of said channel, an annular groove in said head and a threaded mid-portion adapted to be screwably received in said threaded bore of said windage bar; and, (e) means for removably retaining the windage bar and said windage screw in said dovetail channel, said means comprising an upstanding threaded bore in the top of said block that is perpendicular to said channel and opens into it and a screw-headed stop pin that screwably fits into said bore and extends into the annular groove in the head of said windage screw, whereby the pin prevents the windage screw from being removed from the channel but at the same time permits the screw to be turned to advance or retract the bar in the channel and thereby adjust the horizontal position of the sight leaf relative to the handgun and the sight's main body.

2. The adjustable sight of claim 1 wherein the windage bar comprises a flat stem that interconnects the bar's right-cylinder portion to said face of the upstanding plate for the sight leaf, wherein the flat stem is slidably received within the elongated groove portion of the dovetail channel and the right-cylinder portion is shorter than the length of the dovetail channel.

3. The adjustable sight of claim 1 wherein the windage screw has a pin end and the dovetail channel is a three-step bore having a widened first portion for receiving the head of the windage screw when the sight is assembled, a narrower mid-portion for receiving both the right cylinder portion of the windage bar and the windage screw threadably received in the cylinder, and a smaller end portion that is actually a hole in a side of the block, for rotatably receiving a pin end of the windage screw and acting as a bushing for it, said pin end of the windage screw being supported at an opposite side of the sight block to the widened first portion.

4. The sight of claim 1 wherein the windage screw includes a serrated bottom edge on the head thereof that cooperates with a spring-biased detent plunger housed in a well in said dovetail channel for producing a clicking action during turning of the screw.

5. The sight of claim 1 wherein the sight includes means for elevational adjustment of the sight, said means comprising an elevation screw housed in a through bore of the tongue and adapted to be received in a tapped hole in the base of the slot for the handgun, said elevational means also including at least one spring disposed between the tongue and the base of the slot.

6. An adjustable sight as set forth in claim 1 wherein said windage screw has a support end opposite the screw head and including means defining a support hole in the sight block at a position at an opposite side of the sight block to the semicircular portion that receives the screw head.

7. An adjustable sight as set forth in claim 6 wherein the length of the right cylinder portion of the windage bar is less than have the length of the dovetail channel, wherein the length of the right cylinder portion of the windage bar is on the order of the width of the elongated tongue, and wherein the windage bar is disposed substantially centrally of the sight leaf.

8. An adjustable sight as set forth in claim 1 wherein the length of the right cylinder portion of the windage bar is less than half the length of the dovetail channel, and wherein said dovetail channel is continuous.

9. An adjustable sight as set forth in claim 1 wherein the length of the right cylinder portion of the windage bar is on the order of the width of the elongated tongue.

10. An adjustable sight as set forth in claim 1 wherein the windage bar has only a single right cylinder portion that is disposed substantially centrally of the sight leaf.

11. An adjustable rear sight for a handgun comprising:

(a) a main sight body having an elongated tongue adapted to be pivotally received inside a longitudinal slot in the top strap of the frame of a handgun, said tongue having means near one end for pivotally attaching it to the inside of the slot;

(b) said main body including a sight block for removably housing a horizontally slidable sight leaf therein, said block being integral with the opposite end of said tongue and having a dovetail channel that extends from one side of said block toward the opposite side;

(c) a sight leaf adapted to be slidably received within said dovetail channel, said leaf having an upstanding plate with a substantially key-shaped windage bar attached to one face of it, said windage bar having a right cylinder portion with a screw-threaded bore through it, said windage bar being shorter than the length of said dovetail channel;

(d) a windage screw having a head adapted to be received in said dovetail channel, an annular groove in said head and a threaded mid-portion adapted to be received in said through bore of said windage bar; and, (e) means for removably retaining the windage bar and said windage screw in said dovetail channel, said means comprising an upstanding bore in the top of said block that is perpendicular to said channel and opens onto it and a stop pin that fits through the bore and extends into the annular groove in the head of said windage screw, whereby the pin removably holds the windage screw and the windage bar in the block but at the same time permits the windage bar to be screwably advanced or retracted in the channel as the screw is being turned.

12. The adjustable sight of claim 11 wherein the windage bar comprises a substantially flat stem that interconnects the bar's right cylinder portion to the upstanding plate for the sight leaf, wherein the flat stem is slidably received within the dovetail channel and is shorter than the length of said channel.

13. The adjustable sight of claim 11 wherein the windage screw has a pin end and the dovetail channel is a three-step bore having a widened first portion for receiving the head of the windage screw when the sight is assembled, a narrower mid-portion for receiving the right cylinder portion of the windage bar and the windage screw threadably received in the cylinder, and a smaller end portion that is actually a hole in a side of the block, for rotatably receiving a pin end of the windage screw and acting as a bushing for it, said pin end of the windage screw being supported at an opposite side of the sight block to the widened first portion.

14. The sight of claim 11 wherein the windage screw includes a serrated bottom edge on the head thereof that cooperates with a spring-biased detent plunger housed in a well in said dovetail channel for producing a clicking action during turning of the screw.

15. The sight of claim 11 wherein the sight includes means for elevational adjustment of the sight, said means comprising an elevation screw housed in a through bore of the tongue and adapted to be received in a tapped hole in the base of the slot for the handgun, said elevational means also including at least one spring disposed between the tongue and the base of the slot.

16. An adjustable sight as set forth in claim 11 wherein said windage screw has a support end opposite the screw head and including means defining a support hole in the sight block at a position at an opposite side of the sight block to the semicircular portion that receives the screw head.

17. An adjustable sight as set forth in claim 16 wherein the length of the right cylinder portion of the windage bar is less than have the length of the dovetail channel, wherein the length of the right cylinder portion of the windage bar is on the order of the width of the elongated tongue, and wherein the windage bar is disposed substantially centrally of the sight leaf.

18. An adjustable sight as set forth in claim 11 wherein the length of the right cylinder portion of the windage bar is less than half the length of the dovetail channel, and wherein said dovetail channel is continuous.

19. An adjustable sight as set forth in claim 11 wherein the length of the right cylinder portion of the windage bar is on the order of the width of the elongated tongue.

20. An adjustable sight as set forth in claim 11 wherein the windage bar has only a single right cylinder portion that is disposed substantially centrally of the sight leaf.

21. An adjustable rear sight for a handgun comprising a main sight body having an elongated forward portion for attaching the main body to the top of a handgun; a sight block having one end integrally attached to the rear of the forward portion, said block having a dovetail channel along its opposite end for slidably housing a sight blade therein for horizontal movement along the channel; a sight leaf adapted to be slidably received within said dovetail channel; said leaf comprising an upstanding plate having a key-shaped windage bar integrally attached to one face of it, wherein said bar has a threaded through bore and is adapted to be slidably received in said dovetail channel; a windage screw having a head that fits into a portion of said channel and a threaded midportion that is screwably received within said threaded bore of said windage bar and also received in said channel; and, a pin that fits through the top of the sight block and into a groove in the head of the windage screw, whereby the pin removably holds the windage screw and the windage bar in the block but at the same time permits the windage bar to be screwably advanced or retracted in the channel as the screw is being turned.

22. An adjustable rear sight for a handgun accommodated in a slot in the top strap of the gun frame over the cylinder opening comprising:

(a) a main sight body having an elongated tongue with means adjacent one end for pivotally attaching the tongue to the inside of the slot;

(b) said tongue having means for elevational adjustment of the sight, said means including an elevation screw housed in a through bore of the tongue and threadably received in a tapped hole in the base of the slot, said elevation means also including at least one spring disposed between the underside of the tongue and the base of the slot;

(c) said main body including a sight block that is integral with the opposite end of said tongue but wider than it, said block having a dovetail channel for slidably receiving a key-shaped windage bar of a sight leaf and a screwably attached windage screw, wherein said dovetail channel extends from one side of said block toward the opposite side and comprises an elongated groove along an end of the block and a semicircular portion parallel with it;

(d) a sight leaf adapted to be slidably received within said dovetail channel, said leaf including an upstanding plate having the key-shaped windage bar attached to the back of it, said bar having a right-cylinder portion with a threaded bore for threadedly receiving the windage screw and being advanced or retracted in the channel by the screw for horizontal adjustment of the sight when the screw is turned, wherein the windage bar comprises a flat stem that interconnects the bar's right cylinderical portion to one face of the upstanding plate for the sight leaf, wherein the flat stem is slidably received within the elongated groove portion of the dovetail channel and both the stem and right-cylinder portion are shorter than the length of the dovetail channel;

(e) a windage screw having a head adapted to be received in said semicircular portion of said channel, an annular groove in the head and a threaded mid-portion adapted to be screwably received in said threaded bore of said windage bar; and, (f) means for removably retaining the windage bar and said windage screw in said dovetail channel, said means comprising an upstanding threaded bore in the top of said block that is perpendicular to said channel and opens into it and a screw-headed stop pin that screwably fits into said bore and extends into the annular groove in the head of said windage screw, whereby the pin prevents the windage screw from being removed from the channel but at the same time permits the screw to be turned to advance or retract the bar in the channel and thereby adjust the horizontal position of the sight leaf relative to the handgun and the sight's main body.

23. An adjustable sight as set forth in claim 22, wherein said windage screw has a support end opposite the screw head and including means defining a support hole in the sight block at a position at an opposite side of the sight block to the semicircular portion that receives the screw head.

24. An adjustable sight as set forth in claim 22 wherein the length of the right cylinder portion of the windage bar is less than half the length of the dovetail channel, and wherein said dovetail channel is continuous.

25. An adjustable sight as set forth in claim 22 wherein the length of the right cylinder portion of the windage bar is on the order of the width of the elongated tongue.

26. An adjustable sight as set forth in claim 22 wherein the length of the right cylinder portion of the windage bar is less than have the length of the dovetail channel, wherein the length of the right cylinder portion of the windage bar is on the order of the width of the elongated tongue, and wherein the windage bar is disposed substantially centrally of the sight leaf.

27. An adjustable sight as set forth in claim 22 wherein the windage bar has only a single right cylinder portion that is disposed substantially centrally of the sight leaf.

* * * * *